United States Patent [19]

Lekhtman

[11] Patent Number: 4,708,076

[45] Date of Patent: Nov. 24, 1987

[54] WATER SPORT EQUIPMENT

[76] Inventor: David Lekhtman, 324 Rte. 329, Morin Heights, Quebec, Canada, J0R 1H0

[21] Appl. No.: 852,318

[22] Filed: Apr. 15, 1986

[51] Int. Cl.[4] ..... B63H 9/04

[52] U.S. Cl. ..... 114/39.2; 114/91; 114/102; 441/74

[58] Field of Search ..... 114/39.1, 39.2, 91, 114/97, 102, 103; 441/65, 67, 74, 75

[56] References Cited

U.S. PATENT DOCUMENTS

| | | | |
|---|---|---|---|
| 3,335,440 | 8/1967 | Beakbane | 441/67 |
| 3,455,261 | 7/1969 | Perrin | 114/39 |
| 3,716,880 | 2/1973 | Sorenson | 441/67 |
| 3,950,808 | 4/1976 | Sorenson | 441/67 |
| 4,276,848 | 7/1981 | Marker | 114/91 |
| 4,458,859 | 7/1984 | Ganev | 114/39.2 |
| 4,466,373 | 8/1984 | Prade et al. | 114/39.2 |
| 4,558,655 | 12/1985 | De Barge | 114/39.2 |

FOREIGN PATENT DOCUMENTS

| | | | |
|---|---|---|---|
| 2835827 | 2/1979 | Fed. Rep. of Germany | 114/39.2 |
| 3208340 | 9/1983 | Fed. Rep. of Germany | 114/39.2 |
| 3215764 | 11/1983 | Fed. Rep. of Germany | 114/39.2 |
| 3222756 | 12/1983 | Fed. Rep. of Germany | 114/39.2 |

*Primary Examiner*—Jeffrey V. Nase
*Assistant Examiner*—Stephen P. Avila
*Attorney, Agent, or Firm*—Fleit, Jacobson, Cohn & Price

[57] ABSTRACT

A board for carrying the user and a glider held and manipulated by the user. The board includes a rubber band with an inner circumference which is unattached to the top surface of the board and an outer circumference which is attached to the top surface of the board. The user can insert his feet under the band through the unattached inner circumference so that his feet are held by the rubber band in such a manner that he can change position on the top surface of the board without the rubber band releasing the hold on his feet. The glider includes a sail portion of a regular shape and a rigid frame surrounding the sail portion. It also includes a rigid handle. Thus, the glider is adapted to catch the wind to propel the user and the glider can be manipulated in all directions by the user.

13 Claims, 9 Drawing Figures

WATER SPORT EQUIPMENT

BACKGROUND OF THE INVENTION

1. Field of the Invention

The invention relates to water sport equipment. More specifically, the invention relates to such equipment which includes a board member, for carrying the user, and a glider member, held by the user for catching the wind to propel the user, and to determine the course of the board member by manipulation of the glider member.

2. Description of Prior Art

Water sports equipment for carrying a user are known in the art as illustrated in U.S. Pat. No. 3,950,808, Sorenson, Apr. 20, 1976, U.S. Pat. No. 3,716,880, Sorenson, Feb. 20, 1973, U.S. Pat. No. 3,455,261, Perrin, July 15, 1969, and U.S. Pat. No. 4,276,848, Marker, July 7, 1981. Both of the Sorenson patents relate to water ski equipment using circular board members. In the '808 patent, Sorenson teaches stirrup means 18 which fixedly hold the user to the board without allowing the user any freedom of movement. The stirrups 19 in the '880 patent are mounted on a disc 11 which is rotatable relative to the top surface of the board. However, this requires ball bearings to provide a relatively complex arrangement.

Both the Perrin and the Marker patents teach equipment commonly known as sailboards. One of the problems with sailboards is the attachment means for attaching the sail to the board. Perrin teaches a flexible sheet 26 for attaching the sail 18 to the board 10. A user of the Perrin equipment is perfectly free to move in any direction on the board in that Perrin does not teach any means for holding the user to the board. The sail of Perrin along with the handle means 25 and 29 are normal sail means and do not permit complete manipulation of the sail. Thus, the structure as contemplated by Perrin could not be pushed either at both ends or at only one.

The Marker patent teaches a further arrangement for providing flexible attachment of the sail to the sailboard.

All of the equipment as taught in the above patents, and as presently available, are bulky to carry and have only limited use and application.

SUMMARY OF THE INVENTION

It is an object of the invention to provide water sport equipment which overcomes the above disadvantages.

It is a further object of the invention to provide water sport equipment which includes a board member which holds the user but which permits him free movement on the top surface of the board.

It is a still further object of the invention to provide water sport equipment which include a glider member which comprises a sail-type material of regular shape, the sail-type material being surrounded by a rigid frame.

In accordance with the invention there is provided water sport equipment comprising a board member for carrying the user and a glider member held by the user. The board member includes means for holding the feet of the user, the means for holding comprising a rubber band having an outer circumference and an inner circumference. The outer circumference is fixedly attached to the top surface of the board while the inner circumference is unattached to the top surface of the board. The rubber band is centrally disposed on the top surface of the board. Thus, the user can insert his feet under the band through the unattached inner circumference so that his feet are held by the rubber band in such a manner that the user can change position on the board member without the rubber band releasing the hold on his feet.

The glider member comprises a sail portion of regular shape with a rigid frame surrounding the sail portion. The glider also includes rigid handle means whereby the glider member is adapted to catch the wind to propel the user and whereby the glider member can be manipulated in all directions by the user.

BRIEF DESCRIPTION OF DRAWINGS

The invention will be better understood by an examination of the following description, together with the accompanying drawings, in which.

DESCRIPTION OF PREFERRED EMBODIMENTS

Figure 1:
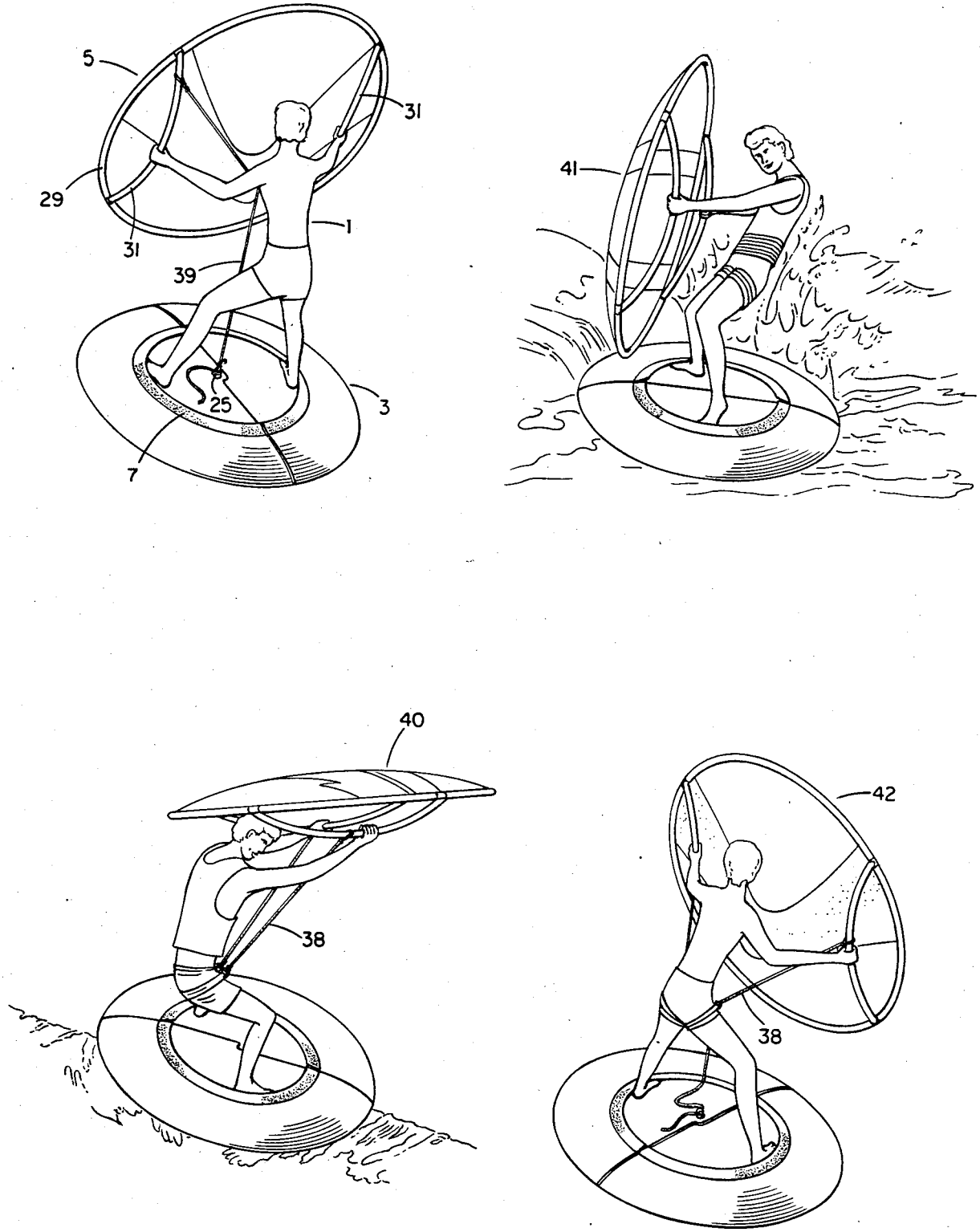
FIG. 1 are perspective views of the equipment in use.
Figure 2:
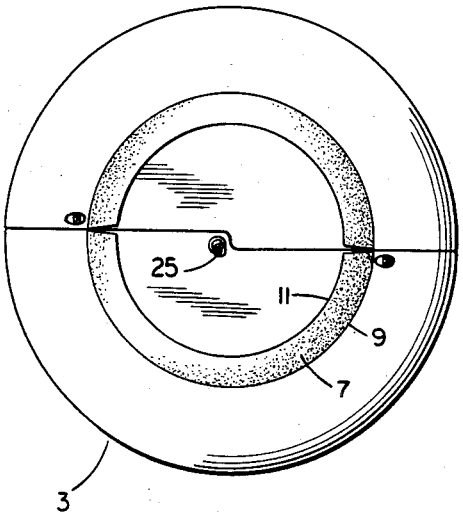
FIG. 2 is a top view of the board member.
Figure 4:
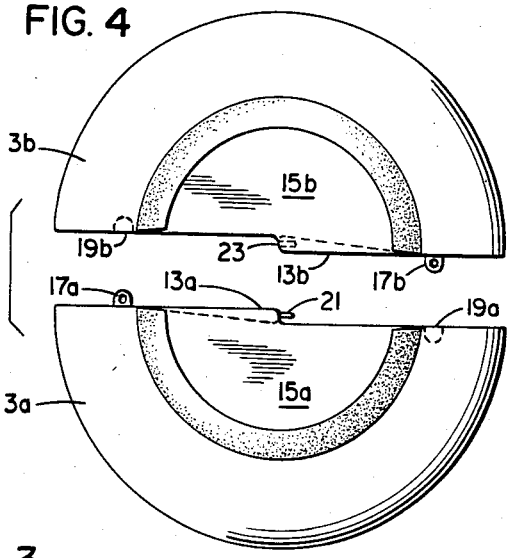
FIG. 4 is a bottom view of the board shown in its constituent half.
Figure 3:
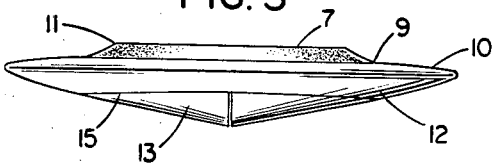
FIG. 3 is a side view of the board member.

FIG. 1 illustrates the novel equipment being used by a person 1, in several attitudes, and consisting of a board member 3 and a glider member 5. Turning to FIGS. 2, 3 and 4, the board member, made of a floatable material such as styrofoam, wood, etc., comprises a rubber band 7 which is centrally disposed on the board member. It will be understood that the board member can be of any regular shape with rounded corners, e.g. oval, but is preferably of circular shape as illustrated in FIGS. 2, 3 and 4. In the drawings, the band 7 is concentric with the board 3.

The rubber band comprises an outer circumference 9 and an inner circumference 11. As best seen in FIG. 3, the outer circumference 9 is fixedly attached to the top surface 10 of the board. The inner circumference is unattached. Thus, a user can insert his feet under the rubber band through the unattached inner circumference as illustrated in FIG. 1.

As seen in FIG. 3, the bottom surface 12 of the board member includes a keel 13 which, as better seen in FIG. 4, extends along a centerline of the board member. With the board member being circular, the keel 13 extends along a diameter of the board member.

A depression 15 is disposed centrally of the bottom surface 12 of the board member. As seen in FIG. 4, the depression is concentric with the board member. The depression causes turbulent air currents to build up under the board whereby to reduce the friction between the board and the water so that, in effect, the depression acts as a bearing for the board.

As seen in FIG. 4, the board is preferably produced in two sections **3*a* and 3*b*. Each section is half of the board, and the keel is also split into two halves 13*a* and 13*b*. Each half of the board includes protrusions 17*a* and 17*b*, as well as mating openings 19*a* and 19*b*. In addition, one end of the keel includes a pin 21 and the mating end of the other keel includes an opening 23 for receiving the pin 21. The protrusions 17 are produced to be force-fitable into the openings 19** whereby the two halves, when assembled, will not break apart without a pulling force.

To assemble the board, the two halves are placed at an angle to each other, and the pin 21 is slid into the opening 23. The two halves are then rotated about the pin 21 in a direction to place them in alignment with each other whereby the protrusions 17 will move into respective ones of the openings 19. It can therefore be seen that the pin 21 and opening 23 comprise a guiding arrangement.

It will also be seen that both halves of the board, 3*a* and 3*b*, are identical to each other. Accordingly, in production, only a single mold is needed to make both of the halves of the board member.

Figure 5:
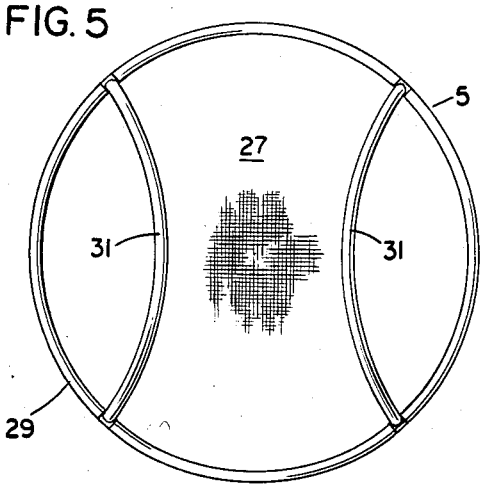
FIG. 5 is a plan view of the glider member.
Figure 6:
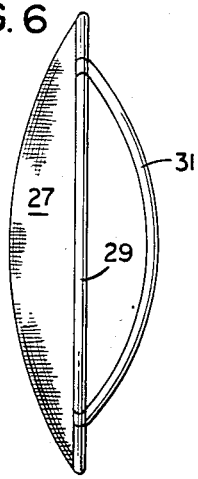
FIG. 6 is a side view of the glider member.
Figure 7:
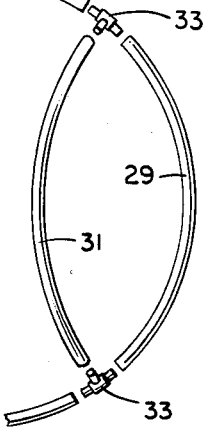
FIG. 7 is an exploded view showing how the handles are attached to the frame of the glider member.

Turning now to FIGS. 5, 6 and 7, the glider member comprises a sail portion 27 which is of a regular shape with rounded corners, e.g. oval, and which is preferably of the circular shape illustrated in FIG. 5. The sail member comprises a sail-type material, for example, canvas or the like. The sail portion 27 is surrounded by a rigid frame which can comprise a metal tubing such as aluminum tubing or rigid plastic tubing. The glider includes handle means 31 which are disposed at diametrically opposed ends of the glider member. The handles 31 are also of a rigid material such as the aluminum tubing or rigid plastic tubing of which the rigid frame is made. T's 33 are used to connect the handles to the frame.

Because of this structure, it is possible to move and manipulate the glider means in any direction in that the entire glider comprises a rigid structure.

Figure 8:
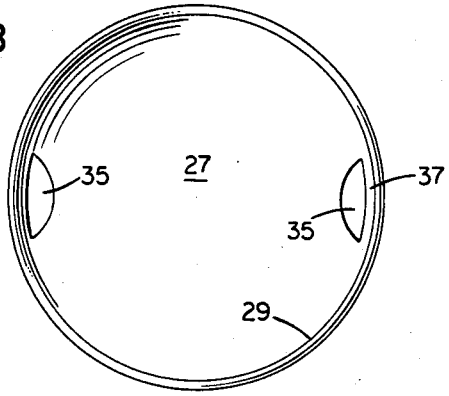
FIGS. 8A and 8B illustrate alternate embodiments of the glider member.
Figure 8A:
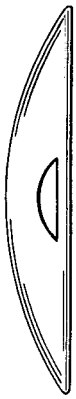

In an alternate embodiment illustrated in FIG. 8, portions 35 are cut out from diametrically opposed ends of the sail portion 27 whereby to provide free portions 37 of the frame. The free portions 37 would comprise the handle means of the FIG. 8 embodiment.

Returning now to FIG. 1, a flexible means such as a rope 39, is provided for attaching the glider member to the board member. This attachment means is provided so that, should the user fall, the glider member will not be picked up by a wind and blown away, or will not simply float away. The flexible means can, instead, be tied to the user himself. The rope, as shown, can be attached to the board 3 or to the user with a harness 38.

In operation, a user mounts on the board as shown in FIG. 1 and grasps the handle means 31 as also shown in FIG. 1. The user can then turn in any direction, without the rubber band 7 releasing its hold of the user, so that he can place the glider to best catch the wind. He can also steer the equipment using the glider in the same manner at the sail, or he can hold the glider horizontally to cause the wind to lift him off the surface of the water.

With the equipment, the user has flexibility in positioning himself on the board member 3, and he also has great flexibility in positioning the glider member for the greatest enjoyment of the water sport.

Although particular embodiments have been described, this was for the purpose of illustrating, but not limiting, the invention. Various modifications, which will come readily to the mind of one skilled in the art, are within the scope of the invention, as defined in the appended claims.

I claim:

1. Water sport equipment to be employed by a user having feet, and comprising:

a board member, having a top surface and a bottom surface, for carrying the user; and a glider member held by said user;

characterized in that said board member includes means for holding the feet of the user, said means for holding comprising a rubber band having an outer circumference and an inner circumference; said outer circumference being fixedly attached to the top surface of said board member; said inner circumference being unattached to said top surface of said board member; said rubber band being centrally disposed on the top surface of said board member;

whereby, a user can insert his feet under the band through the unattached inner circumference so that his feet are held by the rubber band in such a manner that the user can change position on the top surface of the board member without the rubber band releasing the hold on his feet.

2. Equipment as defined in claim 1 wherein said board member has a keel extending longitudinally along a centerline on the bottom surface of said board member.

3. Equipment as defined in claim 2 wherein said board member has a depression centrally disposed on the bottom surface thereof.

4. Equipment as defined in claim 3 wherein said board member is circular in shape;

said depression being circular in shape and concentric with said board member;

said keel extending along a diameter of said board member.

5. Equipment as defined in claim 4 wherein said board member is produced in two sections along said diameter;

half of said keel being located on one of said sections and the other half of said keel being located on the other half of said sections;

whereby both sections are identical.

6. Equipment as defined in claim 1 including flexible means attaching said board member to said glider member.

7. Equipment as defined in claim 5 including flexible means attaching said board member to said glider member.

8. Water sport equipment comprising:

a circular board member for carrying a user; and a circular glider member held by said user;

characterized in that said glider member comprises a sail portion of a regular shape; a rigid frame surrounding said sail portiton; and rigid handle means, said rigid handle means being disposed at diametrically opposed ends of said rigid frame;

whereby, said glider member is adapted to catch the wind to propel the user and whereby said glider member can be manipulated in all directions by said user.

9. Equipment as defined in claim 8 wherein said glider member is circular in shape.

10. Equipment as defined in claim 9 wherein said handle means are arcs of rigid material connected at diametrically opposed ends of said frame.

11. Equipment as defined in claim 9 including cut-out portions of said sail portion at diametrically opposed ends of said sail to leave free portions of said frames adjacent said cut-out portions;

said free portions comprising said handle means.

12. Equipment as defined in claim 11 including flexible means attaching said board member to said glider member.

13. Water sport equipment to be employed by a user having feet, and comprising:

a board member, having a top surface and a bottom surface, for carrying the user; and a glider member held by said user;

wherein said board member includes means for holding the feet of the user, said means for holding comprising a rubber band having an outer circumference and an inner circumference; said outer circumference being fixedly attached to the top surface of said board member; said inner circumference being unattached to said top surface of said board member; said rubber band being centrally disposed on the top surface of said board member;

whereby, a user can insert his feet under the band through the unattached inner circumference so that his feet are held by the rubber band in such a manner that the user can change position on the top surface of the board member without the rubber band releasing the hold on his feet; and wherein said glider member comprises a sail portion of a regular shape; a rigid frame surrounding said sail portion; and rigid handle means;

whereby, said glider member is adapted to catch the wind to propel the user and whereby said glider member can be manipulated in all directions by said user.

* * * * *